US012741228B2

(12) United States Patent
Bederov et al.

(10) Patent No.: US 12,741,228 B2
(45) Date of Patent: Sep. 22, 2026

(54) CONSTRUCTION KIT

(71) Applicant: Yury Bederov, Tbilisi (GE)

(72) Inventors: Yury Bederov, Tbilisi (GE); Sergei Bederov, Tbilisi (GE)

( * ) Notice: Subject to any disclaimer, the term of this patent is extended or adjusted under 35 U.S.C. 154(b) by 283 days.

(21) Appl. No.: 18/709,601

(22) PCT Filed: Nov. 18, 2022

(86) PCT No.: PCT/RU2022/000342
§ 371 (c)(1),
(2) Date: May 13, 2024

(87) PCT Pub. No.: WO2023/091051
PCT Pub. Date: May 25, 2023

(65) Prior Publication Data

US 2025/0001322 A1 Jan. 2, 2025

(30) Foreign Application Priority Data

Nov. 19, 2021 (RU) ..... 2021133820

(51) Int. Cl.
*A63H 33/08* (2006.01)

(52) U.S. Cl.
CPC ..... *A63H 33/08* (2013.01)

(58) Field of Classification Search
CPC ..... A63H 33/08–088
See application file for complete search history.

(56) References Cited

U.S. PATENT DOCUMENTS 319,764 A * 6/1885 Westcott ..... A63H 33/084 52/591.1
2,786,301 A * 3/1957 Torricelli ..... A63H 33/084 52/592.4
2,885,822 A * 5/1959 Onanian ..... A63H 33/101 174/138 D
3,324,619 A * 6/1967 Gearhart ..... A63H 33/086 446/128
3,699,709 A * 10/1972 Schmidt ..... A63H 33/101 206/820
3,721,440 A * 3/1973 Burns ..... A63F 9/30 273/447
3,747,261 A * 7/1973 Salem ..... B23Q 1/545 446/124

(Continued)

*Primary Examiner* — Michael D Dennis
*Assistant Examiner* — Matthew B Stanczak
(74) *Attorney, Agent, or Firm* — Alexander Postnikov

(57) ABSTRACT

A set of interconnectable cubes featuring innovative docking and locking mechanisms. Each cube face has protrusions, recesses, and rotatable locking elements within annular grooves. When two faces align, the grooves become coplanar, allowing the locking elements of both cubes to be rotated simultaneously to securely lock them together. A specialized tool enables the simultaneous rotation, ensuring a firm connection. The locking elements are designed with a rotational limit to prevent falling out, achieved by the structure of the cube, such as spring-assisted tabs. Face caps can be docked to exposed faces, providing a flat outer surface. The patent also outlines a method for securing cubes together, where the locking elements of one cube enter the grooves of another for a secure connection. This versatile system ensures modular, flexible assembly for various applications.

14 Claims, 15 Drawing Sheets

(56) References Cited

U.S. PATENT DOCUMENTS 3,867,784 A * 2/1975 Lange ..... A63H 33/086 446/128
4,003,144 A * 1/1977 Maddestra ..... A63H 33/088 446/122
4,030,209 A * 6/1977 Dreiding ..... G09B 23/26 446/107
4,404,766 A * 9/1983 Toth ..... A63H 33/26 40/426
4,430,826 A * 2/1984 Ryaa ..... A63H 33/088 446/124
4,461,480 A * 7/1984 Mitchell ..... A63F 9/0826 446/128
4,566,246 A * 1/1986 Sanger ..... E04B 1/34384 52/81.3
4,740,189 A * 4/1988 Bertrand ..... A63H 33/086 446/128
4,764,143 A * 8/1988 Gat ..... B65D 81/361 446/120
4,822,315 A * 4/1989 Ben-Gal ..... A63H 33/08 446/104
4,877,406 A * 10/1989 Wilk ..... G09B 23/26 273/153 S
4,895,544 A * 1/1990 Fischer ..... A63H 33/088 446/124
4,932,916 A * 6/1990 Blickle ..... A63H 33/08 446/124
5,022,885 A * 6/1991 Lyman ..... A63H 33/10 446/120
5,098,328 A * 3/1992 Beerens ..... A63H 33/08 446/128
5,106,093 A * 4/1992 Engel ..... A63F 9/12 446/124
5,259,803 A * 11/1993 Lyman ..... A63H 33/08 446/116
5,617,691 A * 4/1997 Yamamoto ..... G21F 3/04 52/603
5,645,464 A * 7/1997 Chen ..... A63H 33/10 446/120
5,762,530 A * 6/1998 Zheng ..... A63H 33/084 446/114
6,086,449 A * 7/2000 Sharp ..... A63H 33/103 446/4
6,595,825 B1 * 7/2003 De Wilde ..... A63H 33/067 403/348
8,157,470 B2 * 4/2012 De Wilde ..... F16B 12/10 403/348
8,540,545 B2 * 9/2013 Leicht ..... A63H 33/106 446/124
9,546,675 B2 * 1/2017 Evitt ..... A47B 47/005
9,839,860 B2 * 12/2017 Rakhsha ..... A63H 33/04
11,278,821 B2 * 3/2022 Brain ..... A63H 33/065
11,351,473 B2 * 6/2022 Lee ..... A63H 33/08
11,613,886 B2 * 3/2023 Van Ee ..... F16S 5/00 52/79.1
11,920,340 B2 * 3/2024 Van Ee ..... A63H 33/10
11,993,932 B2 * 5/2024 Van Ee ..... E04B 2/00
2004/0253901 A1 * 12/2004 Donahue ..... A63H 33/067 446/85
2012/0274023 A1 * 11/2012 Carpenter ..... A63H 33/062 273/276
2013/0203316 A1 * 8/2013 Uno ..... A63H 33/086 446/124
2015/0151211 A1 * 6/2015 Drylie ..... A63H 33/001 446/85
2015/0258463 A1 * 9/2015 Park ..... A63H 33/102 446/124
2015/0290550 A1 * 10/2015 Rodstein ..... A63H 33/082 446/127
2016/0332088 A1 * 11/2016 Rakhsha ..... A63H 33/101
2017/0203226 A1 * 7/2017 Dorasamy ..... A63H 33/084
2018/0056208 A1 * 3/2018 Nakashima ..... A63H 3/16
2018/0117487 A1 * 5/2018 Dumphy ..... A63H 33/084
2018/0243663 A1 * 8/2018 Park ..... A63H 11/18
2019/0266920 A1 * 8/2019 Kim ..... G09B 23/04
2021/0228996 A1 * 7/2021 Voisin ..... A63H 33/084
2022/0042300 A1 * 2/2022 Van Ee ..... E04B 1/34331
2024/0260543 A1 * 8/2024 Axelrod ..... A01K 15/026
2025/0001322 A1 * 1/2025 Bederov ..... A63H 33/08

* cited by examiner

CONSTRUCTION KIT

CROSS-REFERENCE TO RELATED APPLICATIONS

This application is a national stage application of PCT/RU2022/000342, filed on Nov. 18, 2022, which claims priority to RU2021133820, filed on Nov. 19, 2023. The contents of the above-referenced applications are hereby incorporated by reference in their entirety.

BACKGROUND

Field of the Invention

The present invention relates generally to a system of structural elements, and, in particular, to a cube construction kit.

Scope of the Prior Art

Many tinker toy parts have been put forth in the prior art. For example, RU 2459650, RU 2133130, RU 146536, RU 180574, U.S. Pat. No. 6,595,825, RU 58575, RU 136357, RU 2669742, RU 2642530, disclose a variety of thinker toy parts. However, they all have the inherent disadvantage that the parts are only mutually fixed by frictional forces after connection. And when the assembled toy is used, these frictional forces are reduced due to wear. The assembled structure parts can fall apart. The known prior art information source BE 1010737 discloses a thinker toy construction set part which is additionally connected to another part by an intermediate element, including a rotating one, in addition to friction forces. However, although these intermediate elements increase the stability of the assembled structure, they also use friction forces.

SUMMARY

The present disclosure satisfies the foregoing needs by providing, inter alia, a construction kit for addressing each of the foregoing desirable traits as well as methods of its use.

One aspect of the present invention is directed at a set of interconnectable tinker toy parts. The technical effect of the claimed invention is to ensure high reliability of the connection of the tinker toy construction set parts with each other, irrespective of the friction forces between the protrusions and the recesses on the faces. This particular technical effect of the invention is achievable due to providing a set of interconnectable thinker toy parts, each part having a cube at its core, which has protrusions and recesses on each of the faces, positioned in such a manner that the cube can dock with any of the same cube through any of the faces, and has a means of connecting the parts to each other, containing a rotary element. The protrusions are made capable of ensuring precise alignment of the connected faces in the plane when they are joined, and the means for connecting parts is made in the form of a rotary disk located on each face of the part with annular protrusions that can move in the corresponding annular groove made in each face of the part, wherein each the face has an element to interact with the disk, which limits the angle of rotation of the disk to prevent it from falling out of the cube. The element to interact with the disk can be made in the form of a spring-assisted tab, or a screw, or a rivet.

Another aspect of the present invention is directed at interconnectable cubes designed with innovative docking and locking mechanisms. Each cube face features protrusions and recesses, and has rotatable locking elements secured within annular grooves. When any face of a given cube is aligned with the face of another cube, the annular grooves become coplanar, allowing the locking elements of both cubes to be rotated simultaneously. This action securely locks the cubes together by inserting each cube's locking elements into the adjoining cube's annular grooves. A tool is provided to facilitate the simultaneous rotation of these locking elements, ensuring a firm and consistent connection.

The system incorporates a rotational limit for the locking elements, preventing them from falling out of the cubes. This limit is achieved through the specific design of both the faces and the locking elements. Additionally, face caps can be attached to any exposed faces, with an inner surface that docks securely and an outer surface that is flat. This combination of features ensures that the cubes can be interconnected securely and easily, providing a flexible and versatile solution for modular assembly.

Another aspect of the present invention is directed at a method for locking the cubes together. By aligning the annular grooves of two adjoining cube faces and turning the locking elements, the locking elements of one cube enter the annular groove of the other, creating a secure, interlocked structure. The method also involves using the specialized tool for simultaneous rotation of the locking elements and includes face caps to cover exposed faces, enhancing the overall usability and adaptability of the system.

BRIEF DESCRIPTION OF THE DRAWINGS

The foregoing summary, as well as the following detailed description of preferred variations of the invention, will be better understood when read in conjunction with the appended drawings. For the purpose of illustrating the invention, there is shown in the drawings variations that are presently preferred. It should be understood, however, that the invention is not limited to the precise arrangements shown. In the drawings, where:

FIG. 2 shows how the protrusions are received by the recesses, according to an embodiment.

FIG. 3 shows how locking elements receive each other, according to an embodiment.

FIG. 4 shows how the locking elements receive a tool, according to an embodiment.

DETAILED DESCRIPTION

Implementations of the present technology will now be described in detail with reference to the drawings, which are provided as illustrative examples so as to enable those skilled in the art to practice the technology. Notably, the figures and examples below are not meant to limit the scope of the present disclosure to any single implementation or implementations. Wherever convenient, the same reference numbers will be used throughout the drawings to refer to same or like parts.

Moreover, while variations described herein are primarily discussed in the context tinker toy parts, it will be recognized by those of ordinary skill that the present disclosure is not so limited. In fact, the principles of the present disclosure described herein may be readily applied to the connection of any two parts using the described rotary locking mechanism. Alternatively, the principles of the present invention may be used to connect any two polyhedron shapes using the described rotary locking mechanism.

In the present specification, an implementation showing a singular component should not be considered limiting; rather, the disclosure is intended to encompass other implementations including a plurality of the same component, and vice-versa, unless explicitly stated otherwise herein. Further, the present disclosure encompasses present and future known equivalents to the components referred to herein by way of illustration.

It will be recognized that while certain aspects of the technology are described in terms of a specific sequence of steps of a method, these descriptions are only illustrative of the broader methods of the disclosure and may be modified as required by the particular application. Certain steps may be rendered unnecessary or optional under certain circumstances. Additionally, certain steps or functionality may be added to the disclosed implementations, or the order of performance of two or more steps permuted. All such variations are considered to be encompassed within the disclosure disclosed and claimed herein.

Figure 1:
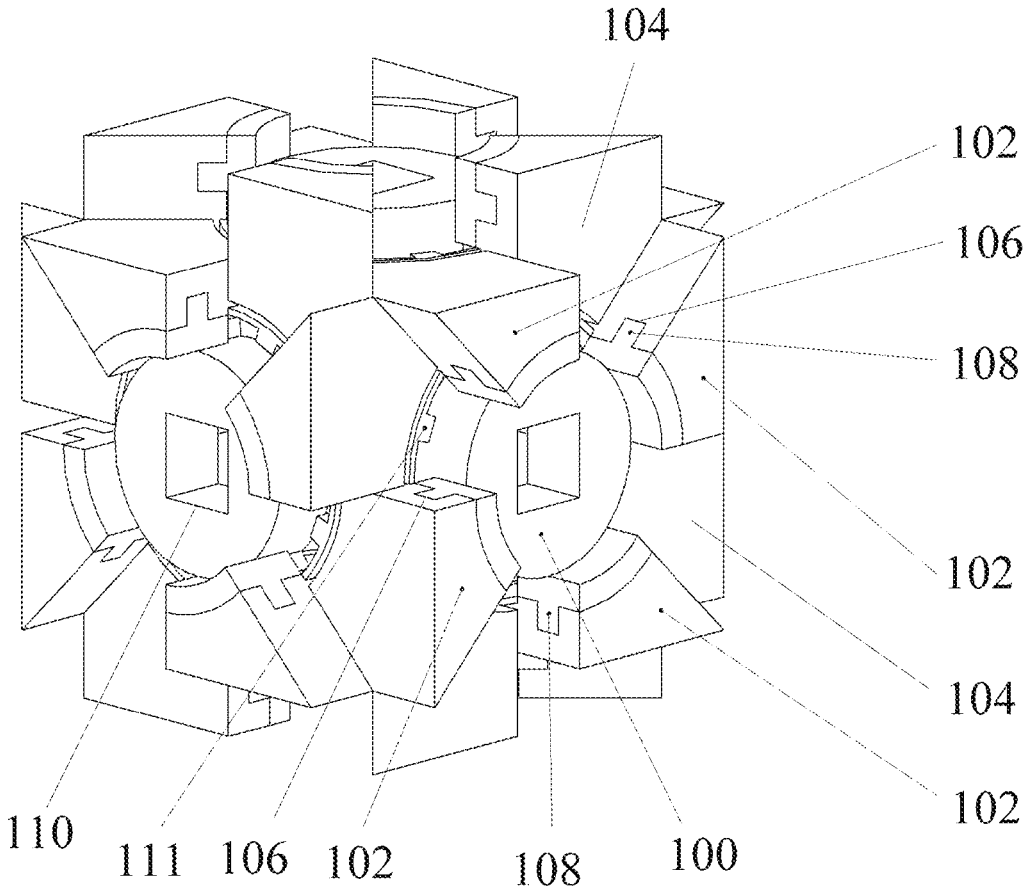
FIG. 1 shows a general isometric view of the part in isometry, according to an embodiment.

FIG. 1 shows an exemplary cube. This cube can be part of a set of identical cubes such that a first cube can be, using any of its faces, docked to another cube in the same set.

Each cube face (herein shortened to face) comprises a locking element 100, at least one protrusion 102, and at least one recess 104. Preferably, there are two protrusions 102 and two recesses 104. The protrusions 102 extend outwards beyond the locking element 100 and the recesses 104 extend inwards beyond the locking element 100. Annular grooves 106 are engraved into the protrusions 102.

Annular protrusions 108 of the locking element 100 sit within the annular grooves 106 such that the locking element 100 is rotatably secured within the face. An aperture 110 in each locking element 100 is configured to receive a tool 112. The end of the tool 112 is shaped to match the apertures 110.

Tabs 111 integrated into the cube body are configured to interact with the locking element 100. Preferably, the tabs 111 are spring-assisted and limit locking element 100 rotation to prevent it from falling out of the cube. Alternatively, the locking element is prevented from falling out of the cube due to at least one of the shape of the cube body and the shape of the locking elements. For example, an additional groove made on the inner surface of the cube or on the disc itself creates an additional barrier for the locking element or its tabs, ensuring the locking element stays inside the cube without limiting its rotation.

Figure 2:
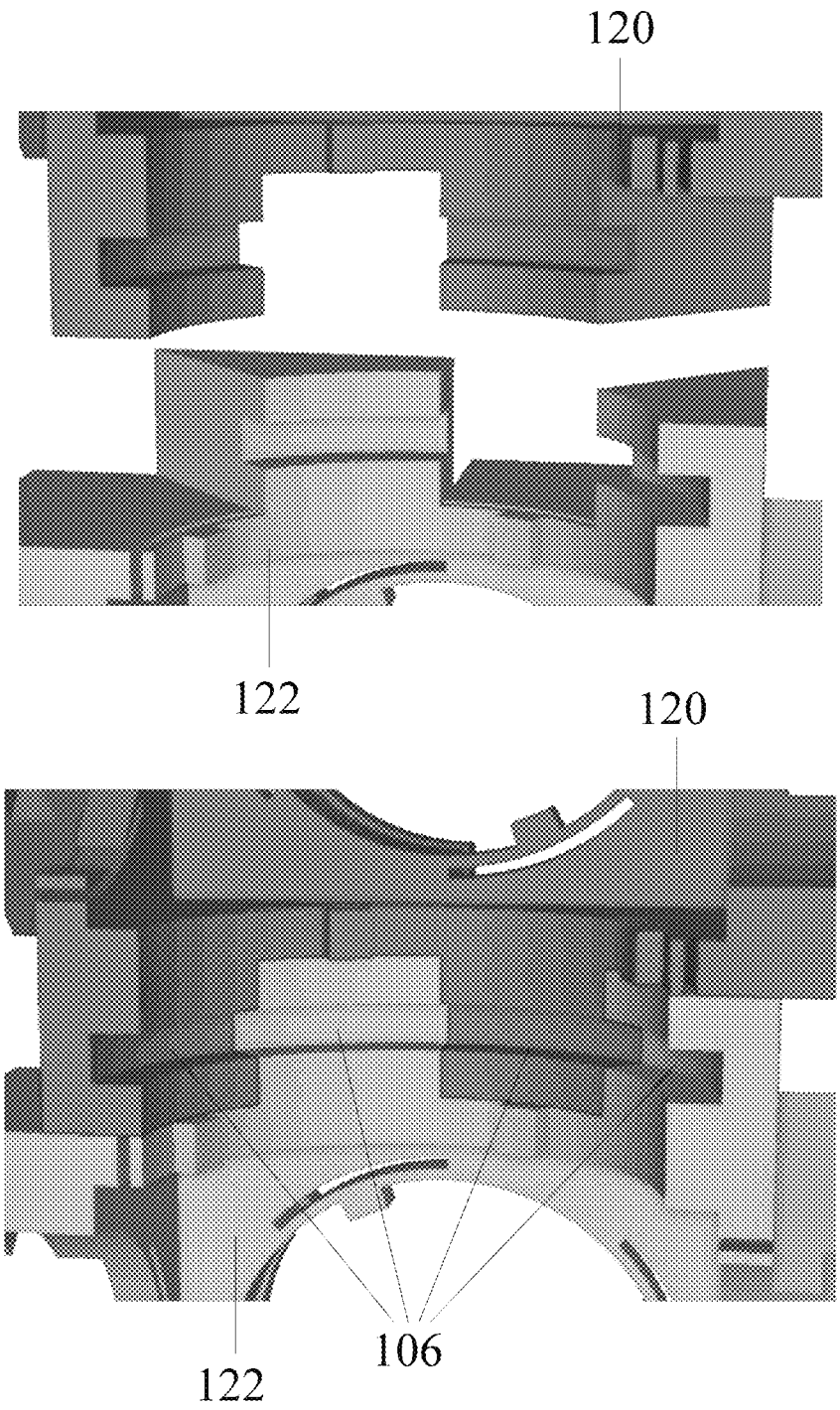
FIGS. 2-4 show steps of a disk positioning process.

FIG. 2 shows how the protrusions 102 are received by the recesses 104. Locking elements are not illustrated for clarity purposes. When the first cube 120 is docked to the second cube 122, the shape of the protrusions 102 and recesses 104 ensures a precise alignment of the faces. Furthermore, the annular grooves 106 of the first cube 120 are coplanar with the annular grooves 106 of the second cube 122.

Figure 3:
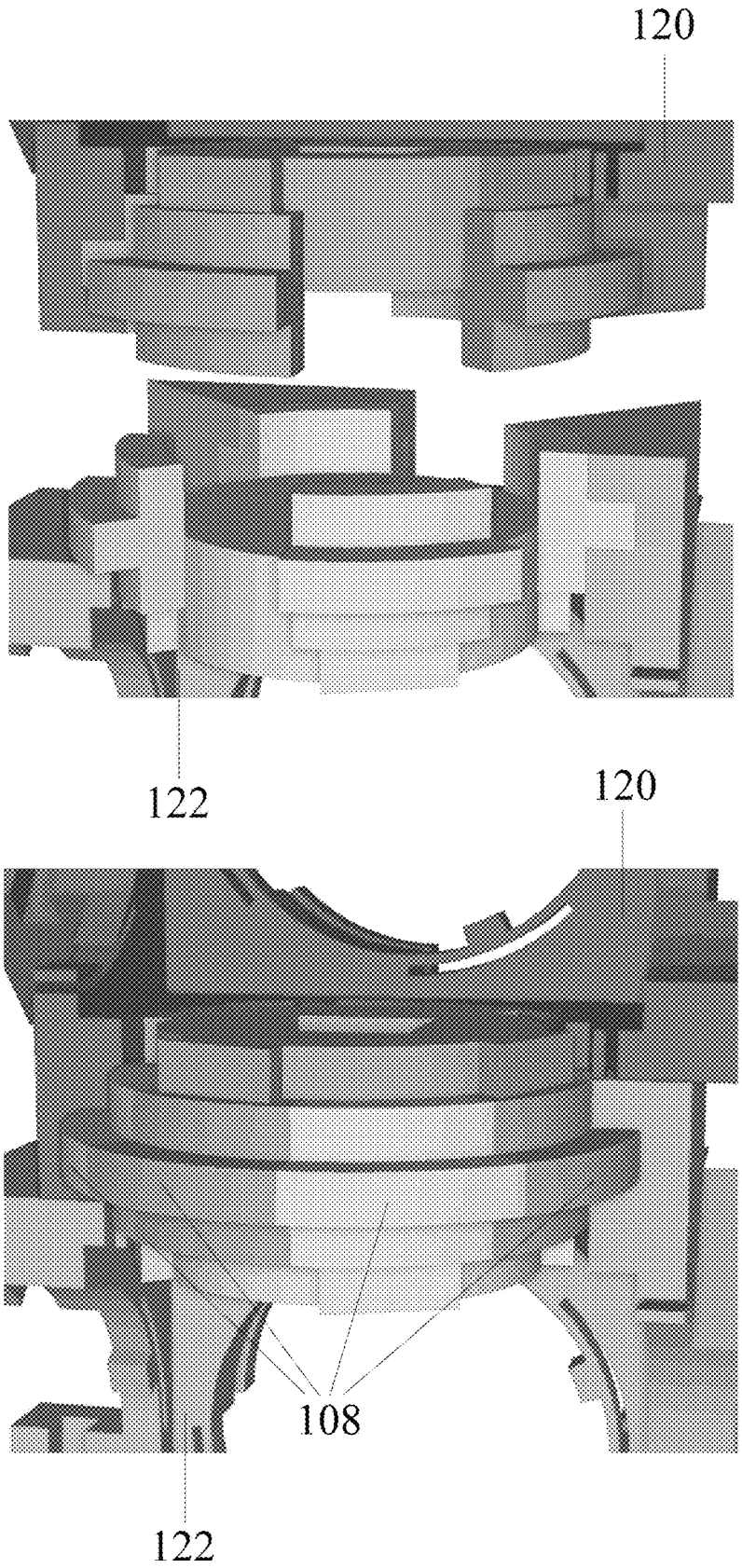

FIG. 3 shows how locking elements 100 receive each other. When the first cube 120 is docked to the second cube 122, the shape of the locking elements 100 ensures a precise alignment of the locking elements 100 to each other. Furthermore, the annular protrusions 108 of the first cube 120 are coplanar with the annular protrusions of the second cube 122.

Figure 4:
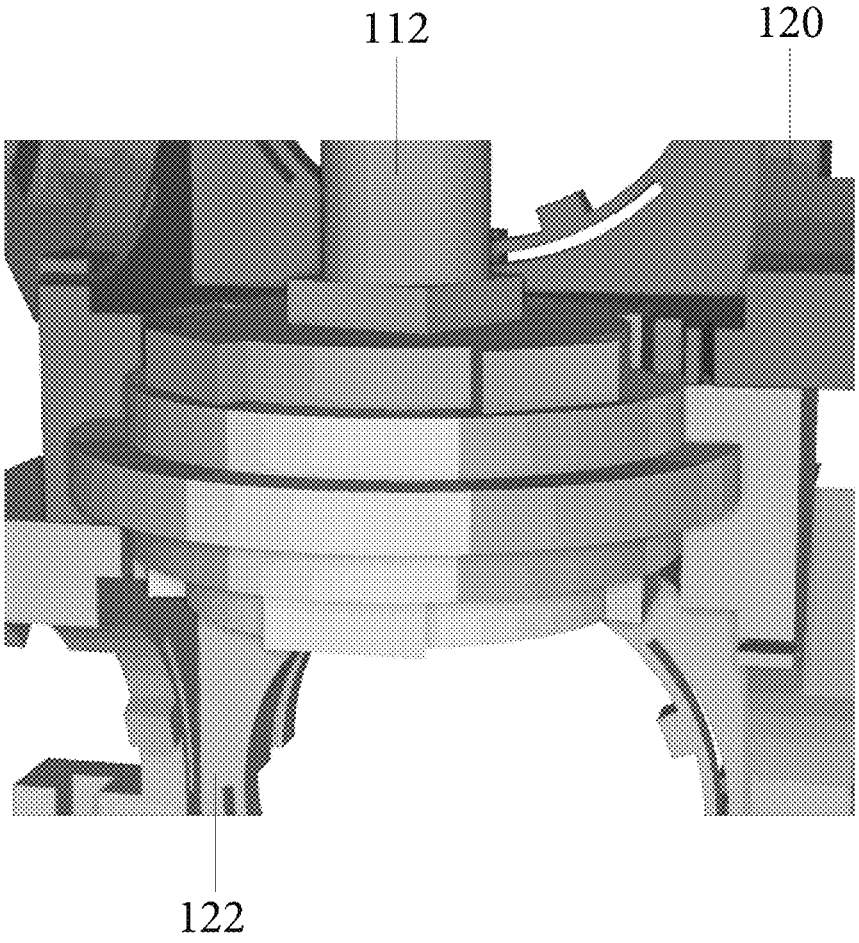

FIG. 4 shows how the locking elements 100 receive a tool 112. The tool 112 shaft is received by the apertures 110 of the locking elements 100. Rotating the tool 112 simultaneously rotates the locking elements 100 such that the annular protrusions 108 of the first cube 120 enter the annular grooves 106 of the second cube 122 and the annular protrusions 108 of the second cube 122 enter the annular grooves 106 of the first cube 110, locking the first cube 120 to the second cube 122.

Figure 5:
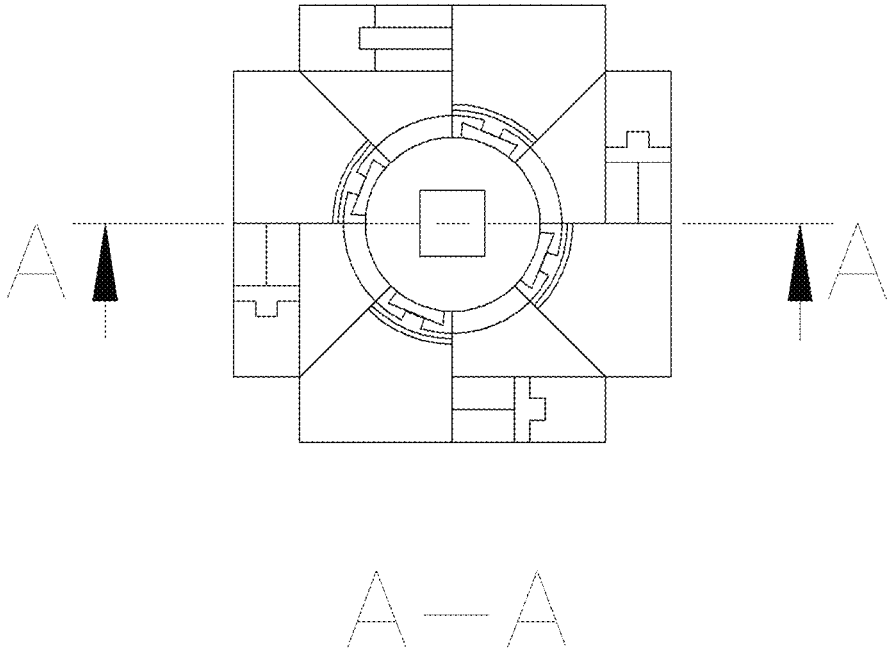
FIGS. 5-7 show a method of positioning the locking element inside of the face, according to an embodiment.
Figure 5:
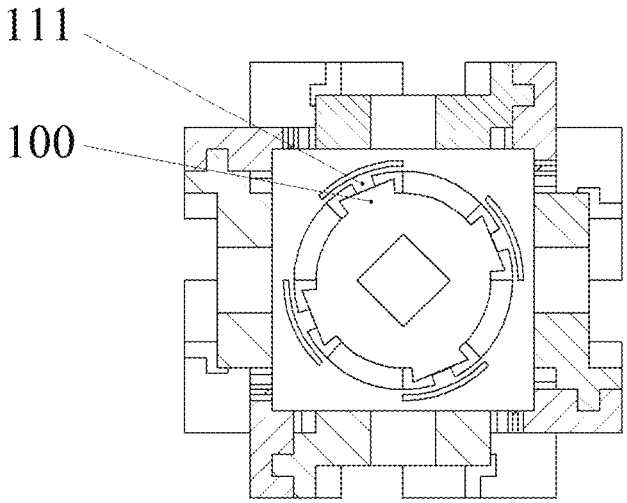
Figure 6:
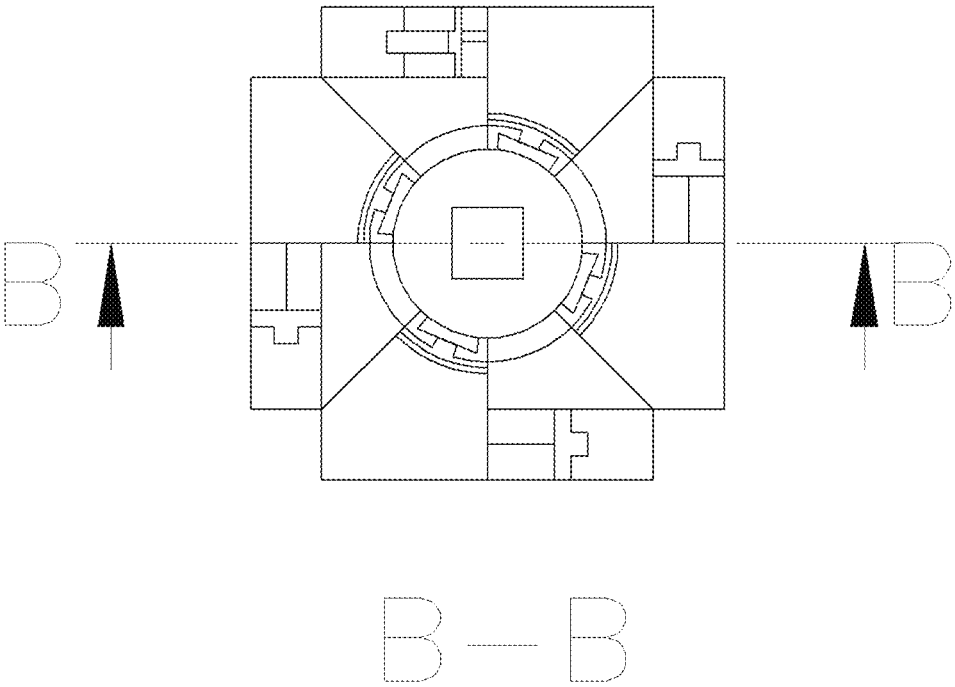
Figure 6:
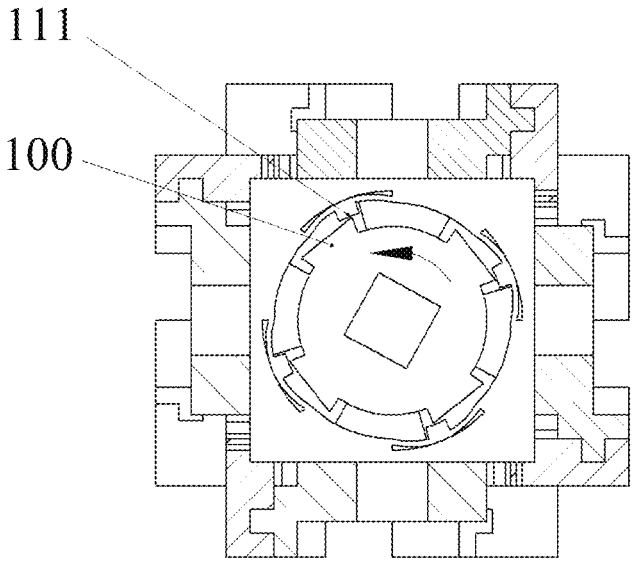
Figure 7:
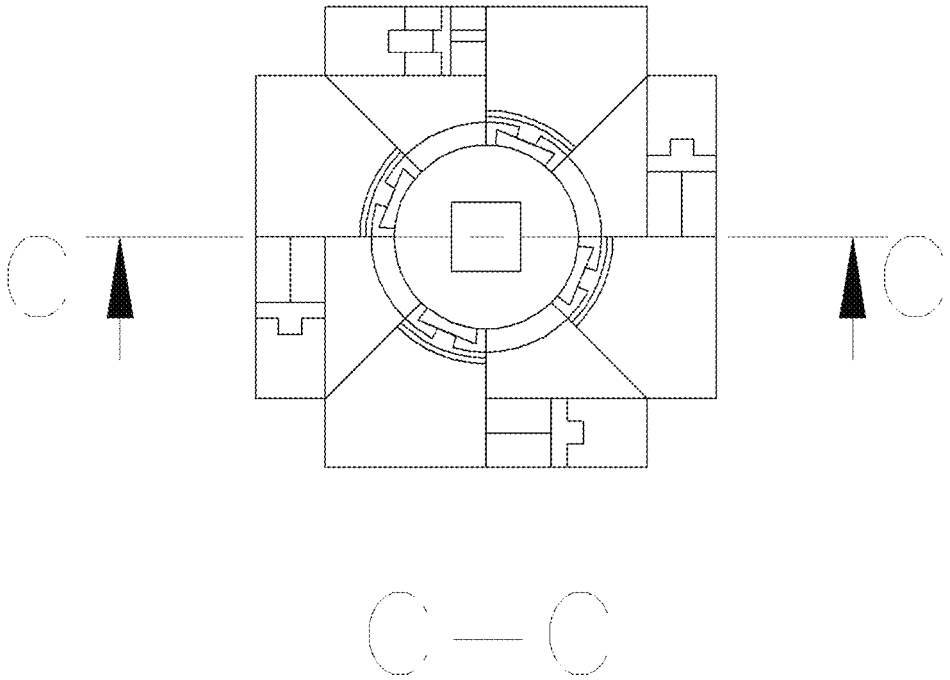
Figure 7:
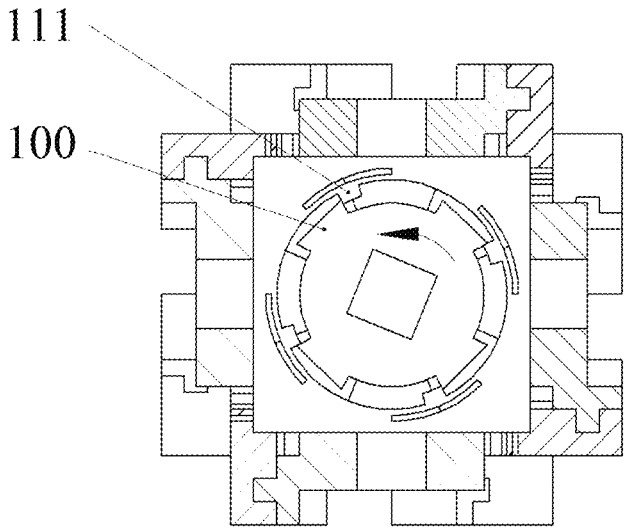

FIGS. 5-7 show how the locking element 100 can be positioned inside of the face.

FIG. 5 shows how the locking element 100 is inserted at 45°.

FIG. 6 shows how the locking element 100 is rotated such that the annular protrusions 108 enter the annular grooves 106. In addition, the spring-assisted tab 111 is deformed inwards under the pressure of the locking element 111.

FIG. 7 shows how the locking element 100 is further rotated such that the spring-assisted tab 111 returns to place. The spring-assisted tab 111 now limits the rotation angle of the disk.

Figure 8:
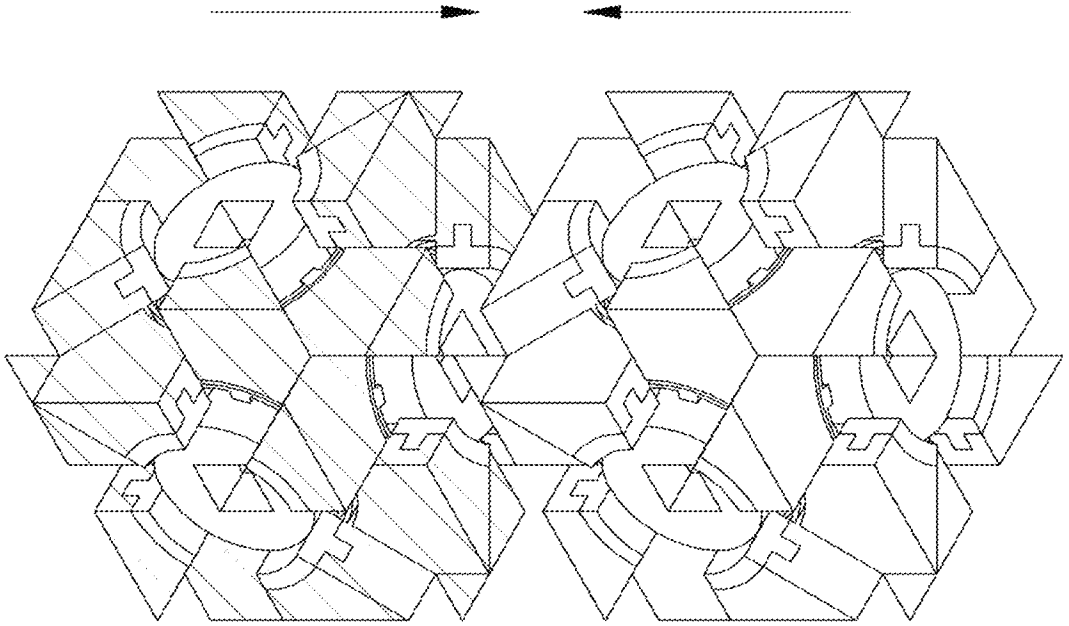
FIGS. 8-10 show a method of locking a first cube to a second cube, according to an embodiment.
Figure 9:
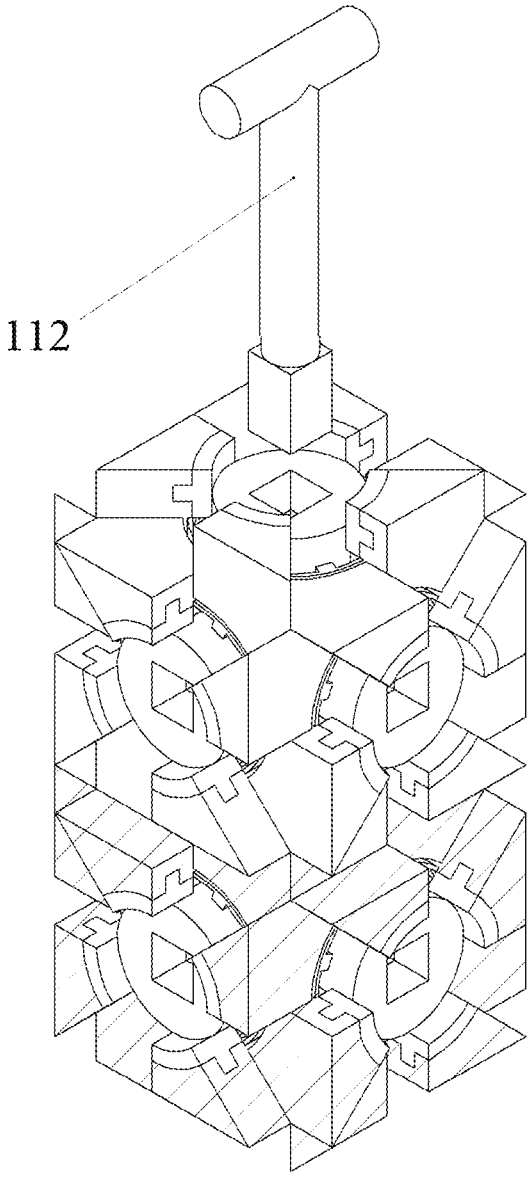
Figure 10:
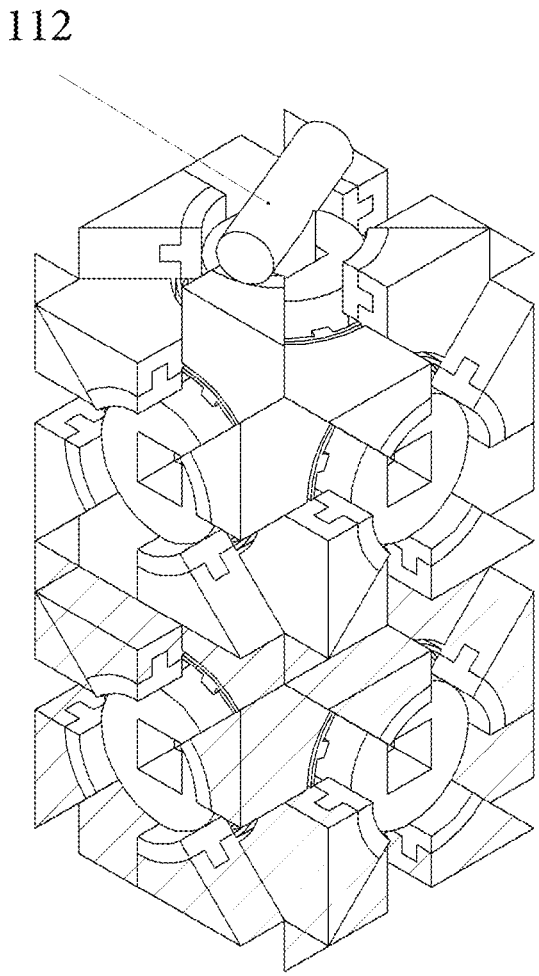

FIGS. 8-10 show the processes of locking a first cube to a second cube, from an outside view.

FIG. 8 shows the first cube being caused to approach the second cube.

FIG. 9 shows the first cube docked to the second cube. The tool 112 can be inserted into the docked cubes.

FIG. 10 shows the tool 112 inserted into the docked cubes. The tool 112 has been used to rotate the locking elements of the two adjoining faces by 22.5°, locking the first cube to the second cube.

Figure 11:
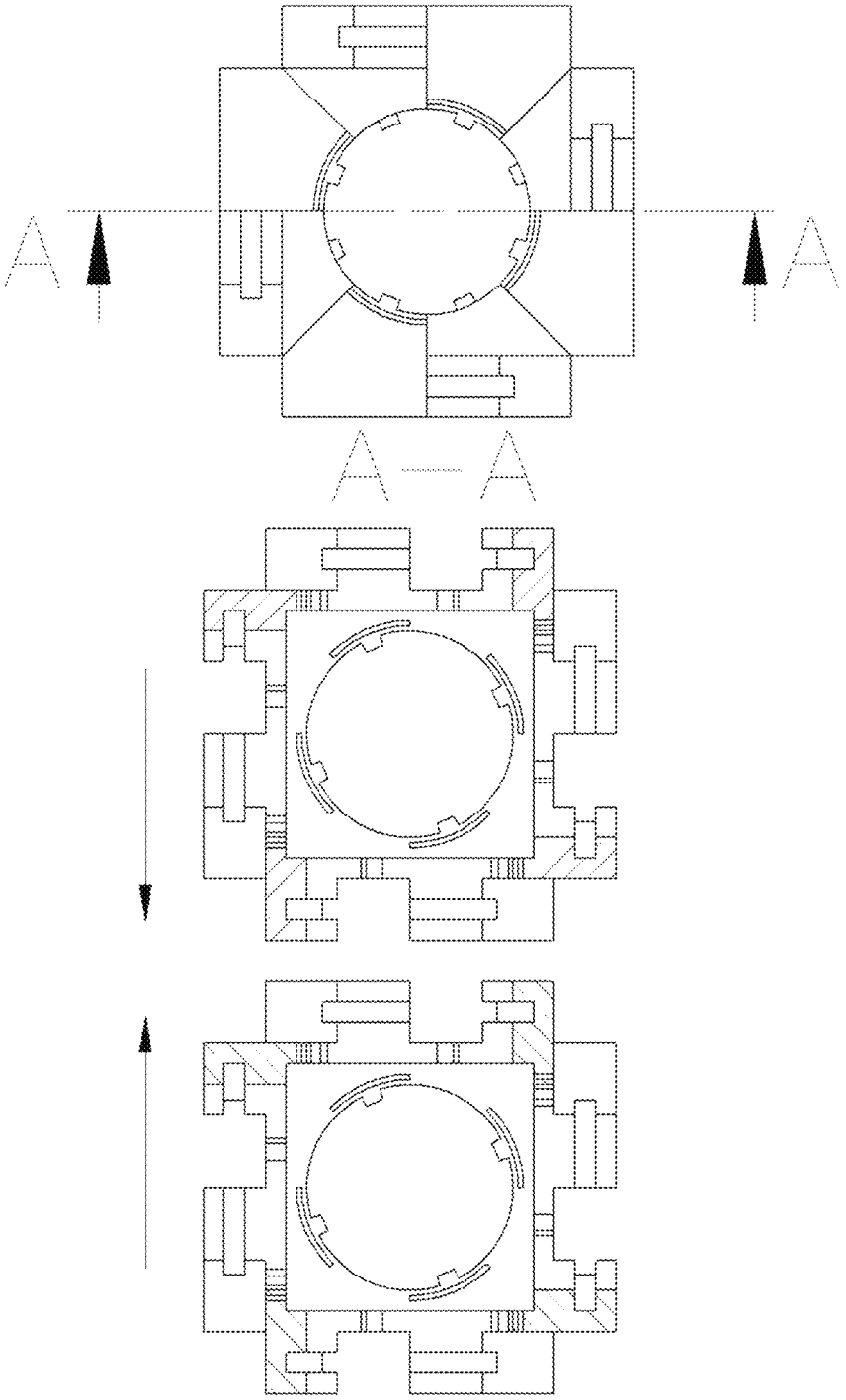
FIGS. 11-12 show a first cube docking to a second cube, according to an embodiment.
Figure 12:
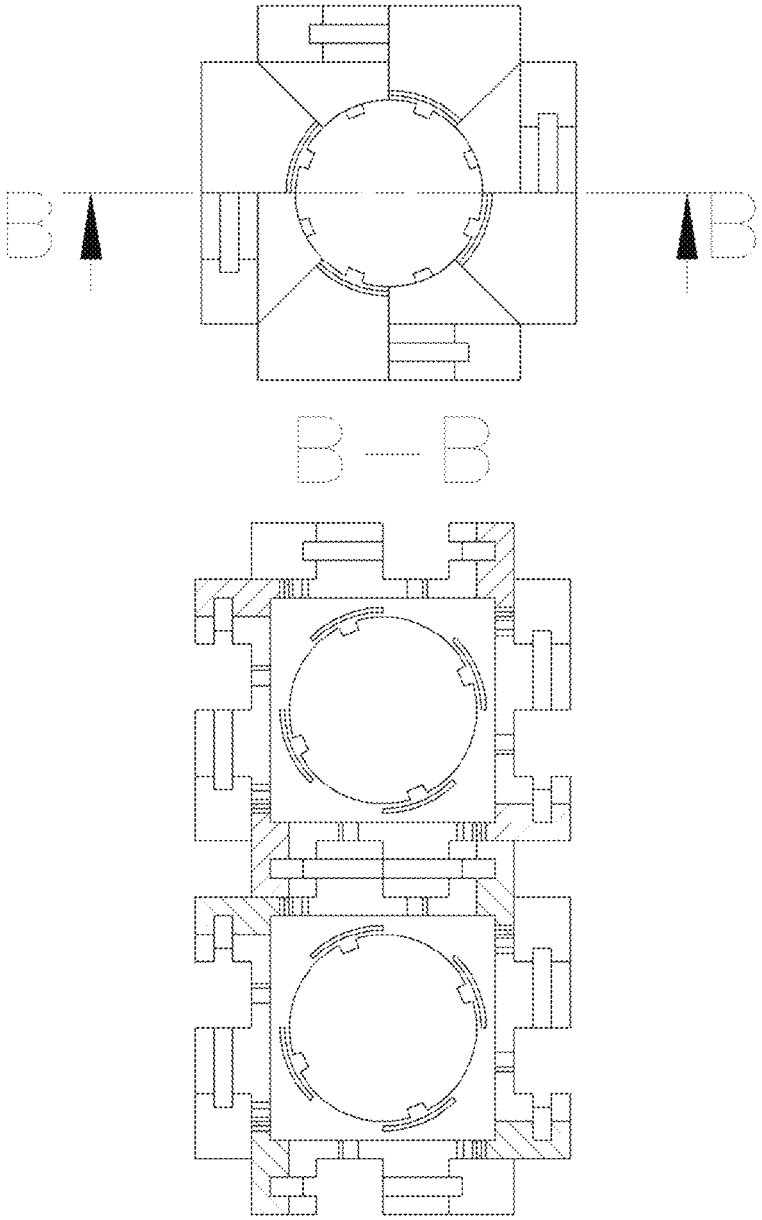

FIGS. 11-12 show a first cube docking to a second cube, from a cross-sectional view.

FIG. 11 shows the first cube being caused to approach the second cube.

FIG. 12 shows the first cube docked to the second cube.

Figure 13:
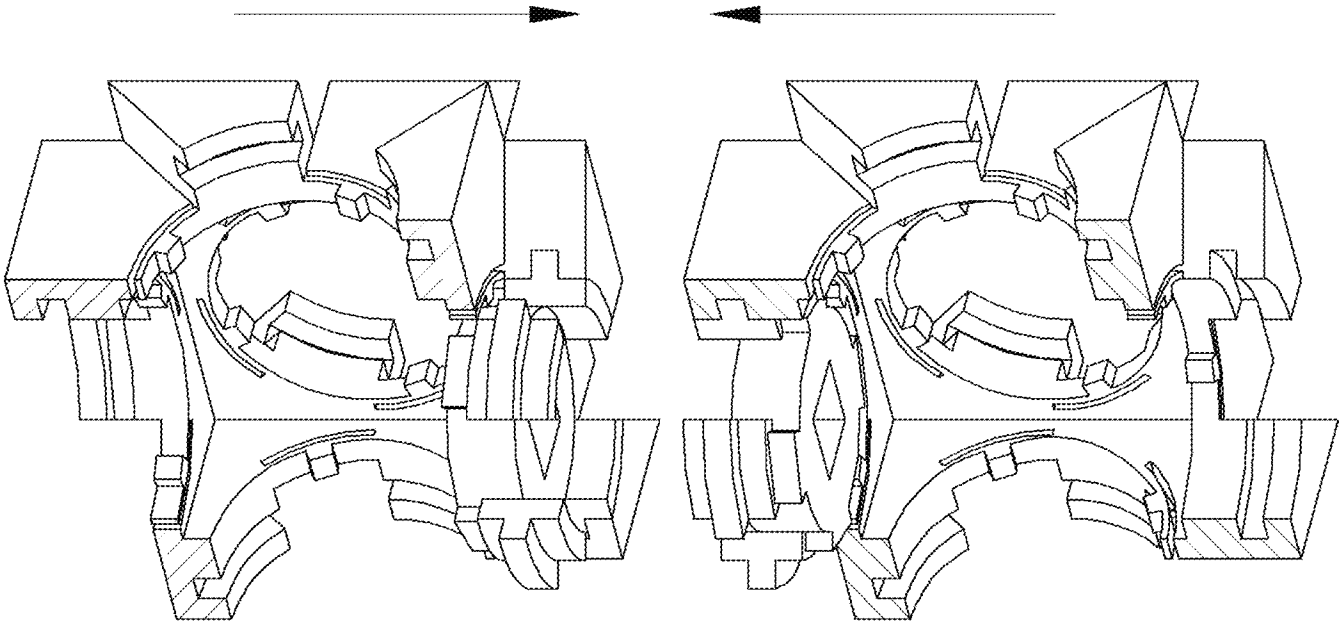
FIGS. 13-15 show a method of locking a first cube to a second cube, according to an embodiment.
Figure 14:
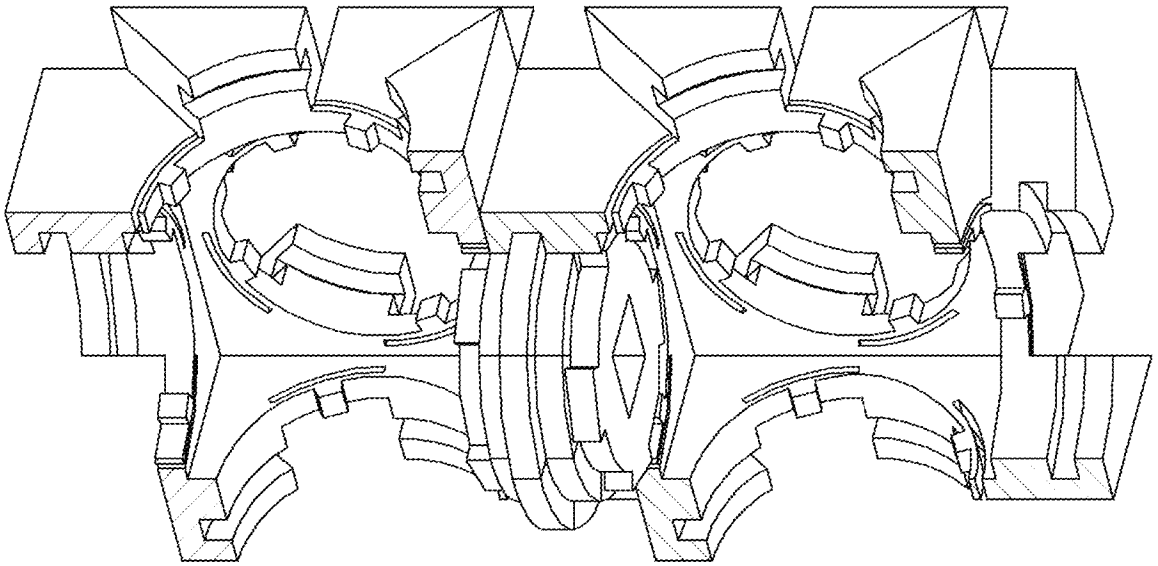
Figure 15:
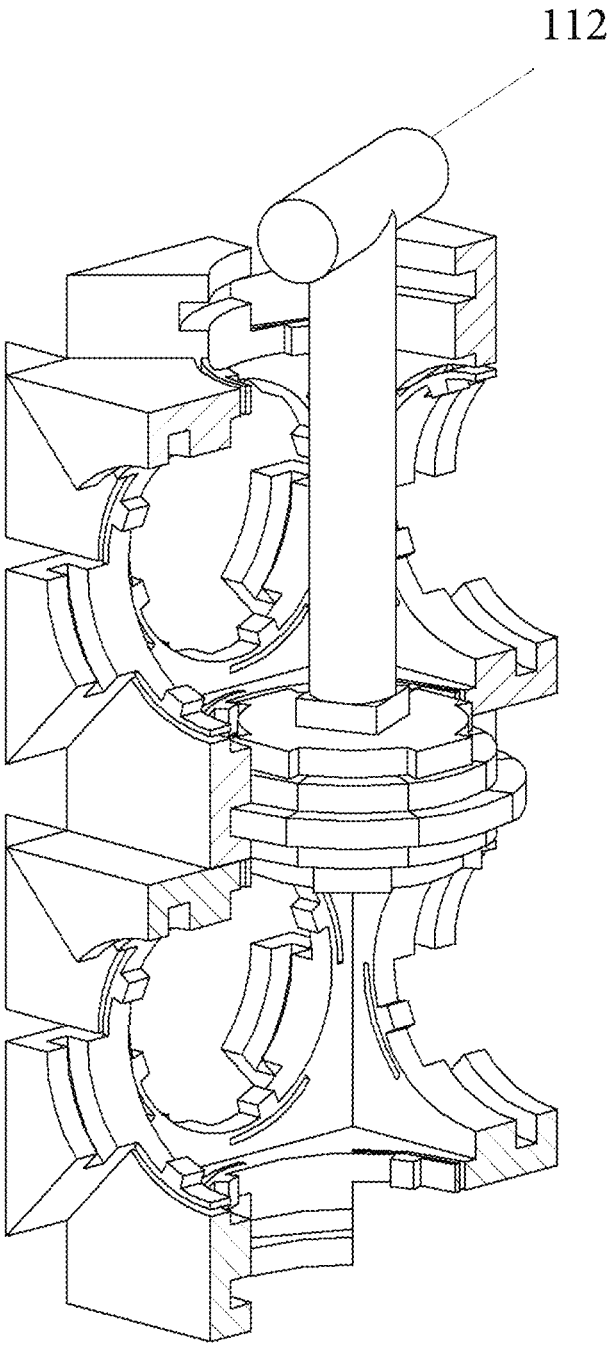

FIGS. 13-15 show the processes of locking a first cube to a second cube, from a cutaway view.

FIG. 13 shows the first cube being caused to approach the second cube.

FIG. 14 shows the first cube docked to the second cube.

FIG. 15 shows the tool 112 inserted into the docked cubes. The tool 112 has been used to rotate the locking elements of the two adjoining faces by 22.5°, locking the first cube to the second cube.

To unlock and undock the cubes, a user can reinsert the tool 112 into the locked cubes, rotate the locking elements of the two adjoining faces by 22.5° in the opposite direction, and undock the cubes from each other.

We claim:

1. A set of interconnectable cubes comprising a first cube and a second cube, wherein the first cube in the set of interconnectable cubes has six faces, wherein each of the six faces of the first cube is characterized by protrusions and recesses;

locking elements are rotatably secured within annular grooves in each of the six faces of the first cube;

the second cube in the set of interconnectable cubes has six faces, wherein each of the six faces of the second cube is characterized by protrusions and recesses;

locking elements are rotatably secured within annular grooves in each of the six faces of the second cube;

the first cube can be docked, through any of the six faces of the first cube, to the second cube such that the annular grooves of two adjoining faces are coplanar; and when the first cube is docked to the second cube, the first cube can be locked to the second cube by simultaneously rotating the locking elements of the two adjoining faces.

2. The set of interconnectable cubes of claim 1, wherein the locking elements of the first cube and the locking elements of the second cube each have a rotational limit that prevents the locking elements from falling out of their respective cube.

3. The set of interconnectable cubes of claim 2, wherein the rotational limit is caused by at least one of:

a shape of the six faces of the first cube and the second cube; and a shape of the locking elements.

4. The set of interconnectable cubes of claim 1, wherein when the locking elements of the two adjoining faces are simultaneously rotated, the locking element of the first cube enters the annular groove of the second cube and the locking element of the second cube enters the annular groove of the first cube.

5. The set of interconnectable cubes of claim 1, further comprising:

a tool configured to simultaneously rotate the locking elements of the two adjoining faces.

6. A cube comprising six faces, the cube part of a set of identical interconnectable cubes, wherein each of the six faces is characterized by protrusions and recesses;

locking elements are rotatably secured within annular grooves in each of the six faces;

the cube is configured to dock, through any of the six faces, to another cube in the set of identical interconnectable cubes such that the annular grooves of two adjoining faces are coplanar; and the locking elements are configured to lock the cube to the other cube, when the cube is docked to the other cube, upon simultaneous rotation of the locking elements of the two adjoining faces.

7. The cube of claim 6, wherein a rotational limit of the locking elements prevents the locking elements from falling out of the cube.

8. The cube of claim 7, wherein the rotational limit is caused by at least one of:

a shape of the six faces; and a shape of the locking elements.

9. The cube of claim 6, further comprising:

a tool configured to simultaneously rotate the locking elements of the two adjoining faces.

10. A method of locking a first cube to a second cube, the method comprising:

providing a first cube having six faces, wherein each of the six faces of the first cube is characterized by protrusions and recesses;

locking elements are rotatably secured within annular grooves in each of the six faces of the first cube;

providing a second cube having six faces, wherein each of the six faces of the second cube is characterized by protrusions and recesses;

locking elements are rotatably secured within annular grooves in each of the six faces of the second cube;

docking the first cube, through any of the six faces of the first cube, to any of the six faces of the second cube such that the annular grooves of two adjoining faces are coplanar; and locking the first cube to the second cube by simultaneously rotating the locking elements of the two adjoining faces.

11. The method of claim 10, wherein the locking elements of the first cube and the locking elements of the second cube each have a rotational limit that prevents the locking elements from falling out of their respective cube.

12. The method of claim 11, wherein the rotational limit is caused by at least one of:

a shape of the six faces of the first cube and the second cube; and a shape of the locking elements.

13. The method of claim 10, wherein when the locking elements of the two adjoining faces are simultaneously rotated, the locking element of the first cube enters the annular groove of the second cube and the locking element of the second cube enters the annular groove of the first cube.

14. The method of claim 10, further comprising:

providing a tool configured to simultaneously rotate the locking elements of the two adjoining faces.

* * * * *